US005893334A

United States Patent [19]

Poranski, Sr.

[11] Patent Number: 5,893,334

[45] Date of Patent: Apr. 13, 1999

[54] METHOD AND APPARATUS FOR MOORING FLOATING STORAGE VESSELS

[75] Inventor: Peter F. Poranski, Sr., Houston, Tex.

[73] Assignee: FMC Corporation, Chicago, Ill.

[21] Appl. No.: 09/126,519

[22] Filed: Jul. 30, 1998

Related U.S. Application Data

[63] Continuation-in-part of application No. 08/905,854, Aug. 4, 1997, which is a continuation of application No. 08/599,859, Feb. 13, 1996, Pat. No. 5,678,503, which is a continuation of application No. 08/339,924, Nov. 15, 1994, abandoned, which is a continuation of application No. 08/162,496, Dec. 3, 1993, abandoned.

[51] Int. Cl.[6] ..... B63B 21/00

[52] U.S. Cl. ..... 114/230; 114/293

[58] Field of Search ..... 441/3–5; 114/293, 114/230

[56] References Cited

U.S. PATENT DOCUMENTS

| | | | |
|---|---|---|---|
| 3,440,671 | 4/1969 | Smulders | 441/5 |
| 4,509,448 | 4/1985 | Pease et al. | 114/230 |
| 4,941,776 | 7/1990 | Bosgiraud et al. | 114/293 |
| 5,044,297 | 9/1991 | De Baan et al. | 114/293 |
| 5,054,415 | 10/1991 | Marshall | 114/230 |
| 5,178,087 | 1/1993 | O'nion et al. | 114/293 |

FOREIGN PATENT DOCUMENTS

| | | | |
|---|---|---|---|
| 8802980 | 1/1990 | Netherlands | 441/4 |

*Primary Examiner*—Ed L. Swinehart

*Attorney, Agent, or Firm*—Bush, Riddle & Jackson L.L.P.

[57] ABSTRACT

A system for mooring a floating storage vessel (10) in the open sea for remaining on station at all times without any disconnection of the vessel (10) from the mooring system. The mooring system includes a plurality of anchor legs (26) connected to a turret (20) in the well (18) of the vessel (10) with at least one submerged support buoy (28) for each anchor leg (26). The submerged support buoy (28), by supporting a substantial portion of the weight of the associated anchor leg (26), reduces the vertical loads on the turret bearings (46, 48) and permits the turret (20) to be easily rotated from the torque exerted by the anchor legs (26) without any separate turret drive means. The system includes in FIG. 5 an embodiment in which a plurality of support buoys (28A) are provided for each anchor leg (26A). The system includes in FIG. 6 an embodiment in which the floating storage vessel (10B) is permanently moored to a mooring buoy (25B) secured by a plurality by anchor legs (26B) to the sea bed (16B).

7 Claims, 4 Drawing Sheets

44
26
28
20
10

44
42
40
D
12
36
38
34
26
28
32
22
16
18
20
30
24
10
14

METHOD AND APPARATUS FOR MOORING FLOATING STORAGE VESSELS

REFERENCE TO RELATED APPLICATIONS

This application is a continuation in part of application Ser. No. 08/905,854 filed Aug. 4, 1997; which is a continuation of application Ser. No. 08/599,859 filed Feb. 13, 1996; now U.S. Pat. No. 5,678,503 dated Oct. 21, 1997; which is a continuation of Ser. No. 08/339,924 filed Nov. 15, 1994 and abandoned; which is a continuation of Ser. No. 08/162,496 filed Dec. 3, 1993 and abandoned.

BACKGROUND OF THE INVENTION

1. Field of the Invention

This invention relates to a method and apparatus for mooring floating storage vessels, and more particularly to such a method and apparatus for the mooring of a floating storage vessel for withstanding storms and the like.

2. Description of Prior Art

Mooring systems for floating storage vessels are known in the mooring system art which have a turret provided in a vessel mounted in a well thereof and supported for rotation therein by bearings. Such turret systems can be classified generally as permanently moored systems, in which the turret is anchored via anchor legs to the sea floor or disconnectable moored systems in which the turret may be quickly detached from the anchor legs.

Disconnectable mooring systems find application in bodies of water in which fierce storms occur or in which ice floes are present. Certain disconnectable mooring systems provide a mooring element or buoy which is permanently placed at the offshore field but which may be connected and disconnected from the turret of a production vessel. Thus, in the event that dangerous weather conditions are imminent, the storage vessel may be disconnected from the mooring system and moved to a safe area to wait until the storm or ice floe passes. When the storm conditions pass, the storage vessel is returned to the offshore field and reconnected to the mooring system which has remained in position.

As shown in U.S. Pat. No. 4,604,961 issued Aug. 12, 1986, a well or moon pool is provided between the bow and stern of a vessel. A turret is rotatably mounted in the well at a position adjacent the bottom of the vessel. The mooring system is connected or disconnected from the turret. Once a mooring system is connected to the turret, the vessel is free to move about the turret. A plurality of mooring lines or legs are attached to the turret and extend to the ocean floor. The mooring lines or legs normally comprise chains and wire ropes or cables, and particularly in deep water are of a substantial weight which is against the turret. The turret is mounted in bearings. Frictional forces exerted by the turret against the bearings can be substantial because of the weight of the anchor legs. The anchor lines, particularly when the vessel is anchored in deep water, such as over 200 meters in depth, exert a substantial vertical load on the turret. A number of anchor lines, such as 8 or 10 anchor lines, are spaced at arcuate intervals about the turret with each anchor line exerting a vertical load on a turret.

Heretofore, such as illustrated in U.S. Pat. No. 4,509,448 dated Apr. 9, 1985, a mooring system has been proposed for turret moored drill ships in which a plurality of spaced mooring lines anchored to the sea floor are releasably connected at submersible buoys to the turret of a drill ship. The drill ship has a disconnect/connect system at the submersive buoys so that the drill ship may be rapidly disconnected from its mooring in the event of precarious weather, such as an approaching storm or the like, and moved out of the path of the approaching storm, ice floes, or the like. After the weather has subsided or passed on, the drill ship is returned to its mooring system and reconnected. However, the specific means and steps involved in connecting and disconnecting the vessel turret from the mooring legs is relatively cumbersome and complex.

SUMMARY OF THE INVENTION

The present invention is directed to a mooring system for a permanently moored floating storage vessel designed to withstand 100 year maximum storm condition The mooring system is of the kind to permit a floating storage vessel to remain on station during storms and other weather conditions without any disconnection from the mooring system.

The mooring system of the present invention includes a plurality of equally spaced anchor legs connected to a turret in a well of the moored vessel with a submerged buoy being provided for each anchor leg for supporting at least a substantial portion of the weight of the anchor leg in order to reduce vertical loads on the turret and its associated bearings. The system is designed to withstand 100 year environmental conditions including storm and ice conditions. The vessel characteristics, the components of the mooring system, and the environmental conditions are coordinated to withstand the forces of surge, sway, roll and yaw of the vessel. The maximum and minimum line loads are developed for each of the anchor legs.

Each of the anchor legs comprises a combination of chain and wire rope with a relatively large submerged support buoy. The submerged support buoy is at least about 20 metric tons and may be submerged at a depth between about 35 and 150 meters depending on such factors as the size of the vessel, the number of anchor lines, and the depth of the water. Risers or riser lines from the sea floor to the turret are provided as a conduit for oil and gas products from hydrocarbon production wells to the vessel. The anchor legs are arranged in an umbrella-like fashion from the turret over the risers. The anchor legs with submerged support buoys are provided so that there is no contact between the risers and the anchor legs at any time even under the most adverse conditions for 100 year environmental or storm conditions.

The present mooring system utilizing submerged buoys for supporting anchor legs has many advantages over a conventional turret mooring system:

(1) A large area is provided for risers so that no interference or contact between the risers and anchor legs is obtained under any conditions of use.

(2) The turret mooring force deflection characteristics are linear over the displacement range of the moored vessel. Thus, large system forces are not generated from small displacement offsets of the vessel.

(3) The total system vertical loads on the turret are small thereby to simplify the design and reduce the cost of the mooring system.

(4) The submerged support buoys improve the geometry of the anchor legs to provide a sufficient torque from the relatively large horizontal force component in the anchor lines so that a separate turret drive system is not required for rotative movement of the turret.

(5) The wave frequency loads on the anchor legs are low to minimize fatigue of the anchor legs and mooring system.

(6) The support buoys are advantageous during initial installation of the anchor legs for the mooring system.

(7) As a result of the force-deflection characteristics that are inherent in the resulting arrangement, installation tolerances for anchor/anchor pile placement may be increased without adversely affecting mooring system performance.

As indicated above, the axial line force curve and the net restoring force curve for the anchor legs of the present invention are substantially linear for displacement of the vessel thereby minimizing any peak loads in the anchor legs and the turret. Non-linear force curves provided relatively large force variations in the anchor legs for relatively small offsets or displacements of the vessel and are therefore undesirable.

Each anchor leg extends from the turret to the submerged buoy, and from the submerged buoy to the sea floor. The weight of each anchor leg below the associated submerged buoy is not transferred to the turret. Only about 50 percent of the weight of the anchor legs supported between the submerged buoy and the turret is transferred to the turret. Thus, a minimal weight of the anchor leg is transmitted to the turret. Furthermore, the horizontal component of the weight of an anchor leg between the submerged buoy and the turret is proportionally greater relative to the vertical component as compared with a conventionally moored vessel in which submerged buoys are not connected in the anchor legs. The horizontal force component applied against the turret provides a relatively large torque that permits rotation of the turret without separate turret drive means.

In some instances, it may be desirable to have more than one submerged support buoy for each anchor leg with a catenary extending from each of the buoys. Also, catenary anchor legs with one or more support buoys in each anchor leg may be utilized for anchoring an offloading mooring buoy or mono-buoy. The offloading mooring buoy may be connected to a suitable mooring boom or yoke extending from the bow of a vessel or may be mounted within a well in the hull of the vessel. Such anchor legs provide a permanent mooring for the offloading mooring buoy without any quick disconnection from the anchor legs and any quick reconnection to the anchor legs. The vessel is permanently moored to the mooring buoy.

It is an object of this invention to provide a mooring system for a floating storage vessel which is designed to remain on station during storms and other environmental conditions.

It is a further object of this invention to provide such a mooring system in which an anchor leg extending from a turret in the storage vessel is supported from a submerged support buoy for minimizing vertical loads on the turret from the anchor leg.

An additional object of this invention is to provide for an oil or gas storage vessel having a plurality of risers extending to the sea floor, a plurality of anchor legs spaced about the vessel and supported by submerged support buoys outwardly from the vessel in an umbrella-like effect over the risers in order to prevent any contact between the anchor legs and the risers even under the most adverse environmental conditions so as to permit the vessel to remain on station at all times.

Another object is to provide a permanent mooring system for an offloading mooring buoy in which a plurality of anchor legs secured to the sea bed each has a plurality of submerged support buoys for supporting the anchor legs.

Other objects, features and advantages of this invention will become more apparent from the following specification and drawings.

DESCRIPTION OF THE INVENTION

Embodiment of FIGS. 1–4

Figure 1:
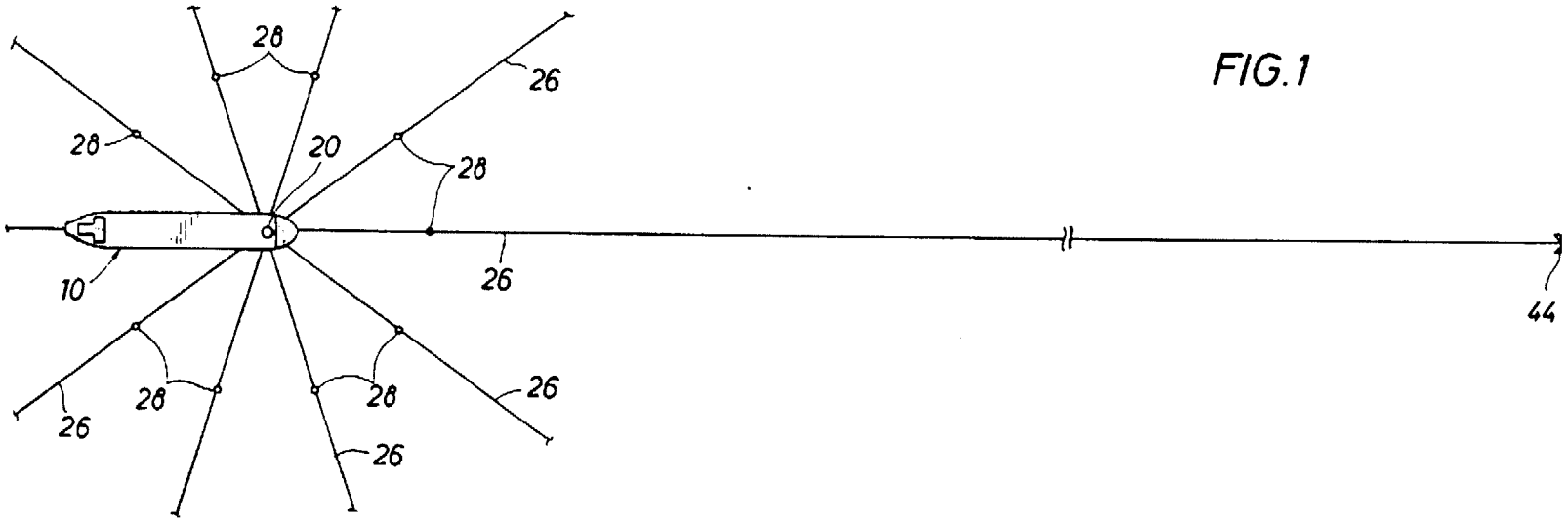
FIG. 1 is a schematic plan view of an oil or gas storage vessel moored with a plurality of anchor legs to the sea floor in accordance with the present invention.
Figure 2:
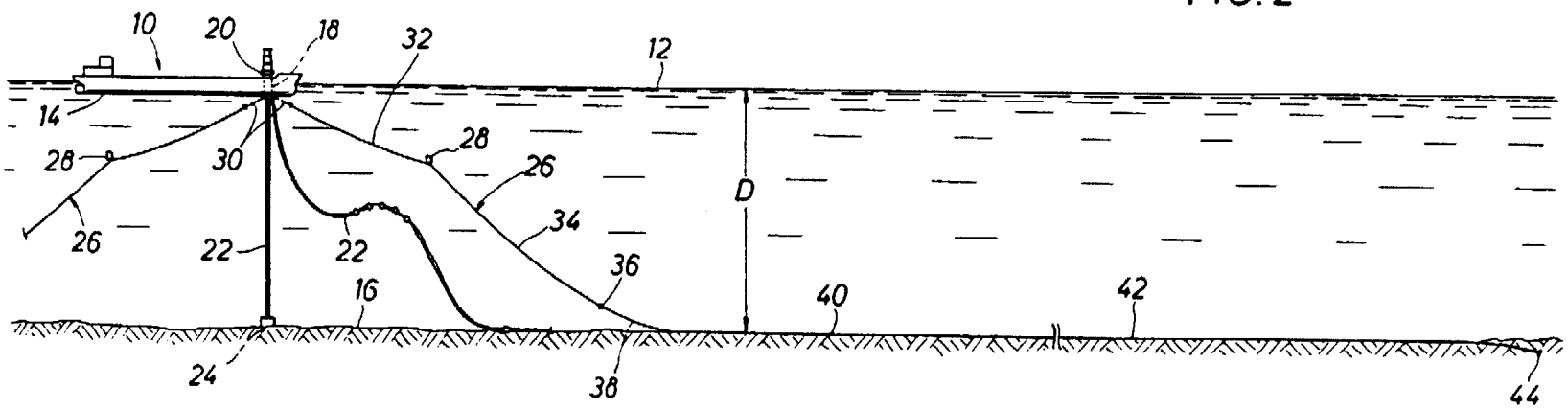
FIG. 2 is a schematic elevational view of the vessel in FIG. 1 showing an anchor leg secured to the vessel and extending to an anchor in the sea bed.

Referring to the drawings and particularly the embodiment of FIGS. 1–4, a vessel 10 for the storage of oil or gas is shown as floating on the surface or sea level 12 of a body of water, such as a sea or ocean. Vessel 10 has a keel 14 positioned below the sea surface 12. The sea bed or sea floor is shown at 16. Vessel 10 has a moon pool or well at 18 centrally of the width of vessel 10. A turret, generally indicated at 20, is mounted within well 18 for rotation about a vertical axis as will be explained further below.

Flexible risers 22 extend from turret 20 downwardly to sea floor 16 and are connected to production wells such as illustrated at 24 for the transport of oil or gas to storage vessel 10 for temporary storage. Risers 22 have a sufficient flexible length to permit a predetermined movement of vessel 10 without any damage to risers 22. For some uses, risers 22 may be substantially rigid or have a limited flexibility.

A plurality of anchor legs indicated generally at 26 are spaced about turret 20 (at arcuate intervals of thirty-six (36) degrees in a preferred embodiment) as shown particularly in FIG. 1. Each anchor leg 26 is generally identical and includes a plurality of connected chains and wire ropes. Various combinations and types of chains and wire ropes or cables may be provided, as desired, for each anchor leg 26. Also, a cable or rope may, under certain conditions, be formed of a suitable material other than wire. Connected intermediate the length of each anchor leg 26 is a submerged support buoy generally indicated at 28 which forms an important part of this invention. Submerged support buoy 28 is of a relatively large size, at least around 20 metric tons in displacement, and may be around 50 metric tons in displacement. A support buoy 28 of about 35 metric tons is adequate for most applications. The weight of the chains and wire ropes forming the catenary or long length line between support buoy 28 and vessel 10, and the weight of the wire ropes and chains between buoy 28 and sea floor 16, cause support buoy 28 to be submerged. The depth of support buoy 28 is determined by the equilibrium point where the upward force from the buoyancy of buoy 28 balances the downward force from the chains and wire ropes. An equilibrium depth of buoy 28 may, for example, be around 75 meters and generally is at a submerged depth range between about 40 and 150 meters.

The depth of support buoy 28 is also designed so that any contact between anchor lines 26 and risers 22 is prevented even upon the most adverse storms or other environmental conditions expected to be encountered by vessel 10 while remaining on station. As support buoy 28 sinks in the water, the loading on such buoy 28 decreases as a result of an increased amount of the anchor leg laying on sea floor 16.

The downward weight of the chains and wire ropes for anchor leg 26 and the desired depth of submerged buoy 28 generally determines the size of buoy 28. However other factors include the size and type of vessel, the number of anchor legs, and the environmental conditions for a 25, 50, 75 or 100 year design period. The environmental conditions include current, wave and wind conditions, water depth, and possible ice conditions. Ballast may be added to buoy 28 to provide the precise buoyancy required to yield the desired equilibrium depth. The equilibrium depth of buoy 28 will also vary dependent on whether the associated anchor leg is the most loaded anchor leg or the least loaded anchor leg as determined by the pull from vessel 10. The difference in depths of submerged support buoys 28 of the most loaded anchor leg and the least loaded anchor leg may vary from 20 to 25 meters, for example, depending primarily on the length of the anchor leg.

Each anchor leg 26 as shown in the drawings includes a short length of chain 30 connected to turret 20, and a wire rope 32 connected between chain 30 and submerged support buoy 28 to form a catenary between vessel 10 and buoy 28. A wire rope 34 extends from buoy 28 downwardly toward the sea floor 16. It is connected at 36 above sea floor 16 to a chain 38 which runs along the surface of sea floor 16. Chain 38 is connected at 40 to wire rope 42 which extends along sea bed 16 to an anchor 44 embedded in the sea bed. As a specific example of design parameters of an anchor leg for one proposed system, a 140,000 dwt vessel is shown having ten (10) anchor legs 26 as shown FIG. 1, where chain 30 is about 5 meters in length, wire rope 32 is about 200 meters in length, wire rope 26 is about 275 meters in length, chain 38 is about 325 meters in length, and wire rope 42 is about 1,000 meters in length.

Figure 4:
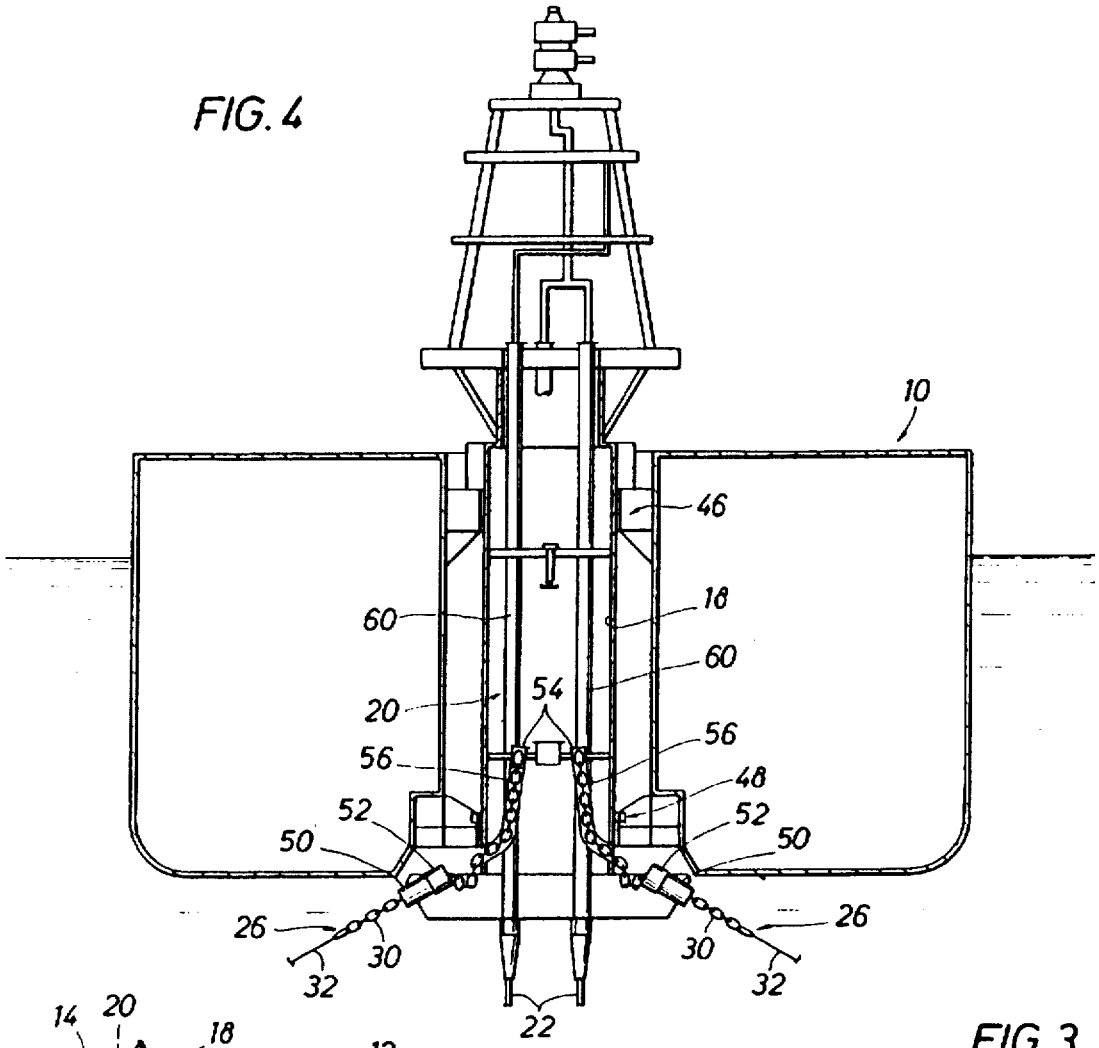
FIG. 4 is a sectional view of a turret for the storage vessel having risers extending downwardly therefrom and showing anchor legs connected to the turret.
Figure 3:
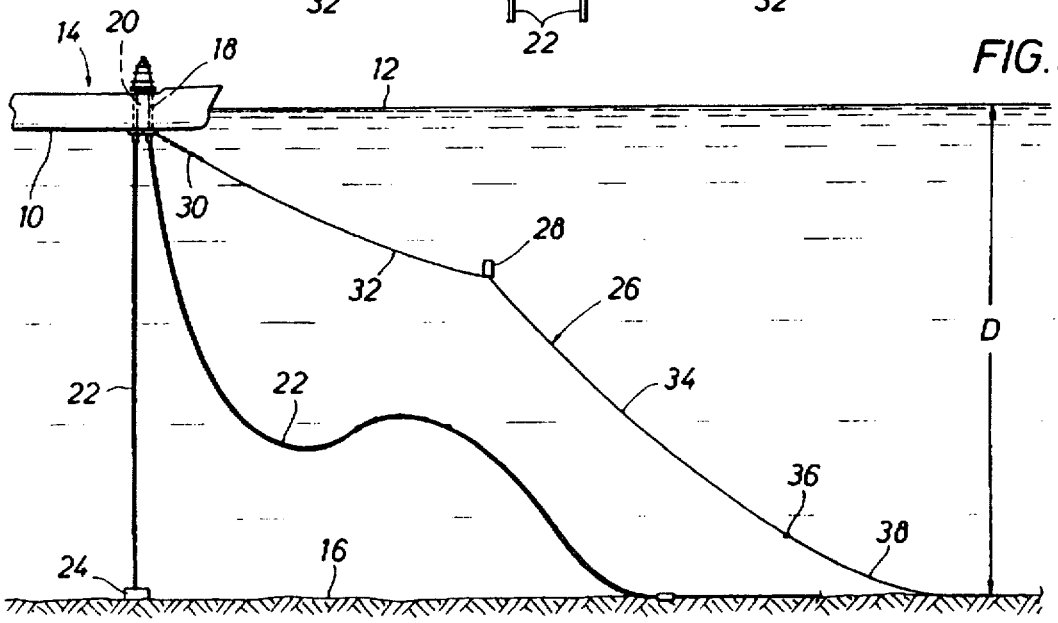
FIG. 3 is an enlarged fragment of FIG. 2 showing further features of the anchor leg and turret to which the anchor leg is connected.

As shown in FIG. 4, turret 20 is mounted for rotation on an upper bearing assembly generally indicated at 46 and a lower bearing assembly indicated at 48. Bearing assemblies 46 and 48 may be of a suitable design such as illustrated in co-pending application Ser. No. 07/767,026, dated Sep. 27, 1991 entitled "Disconnectable Turret Mooring System", now U.S. Pat. No. 5,316,509, the entire disclosure of which is incorporated by this reference. Chain 30 is received within a sleeve 50 secured to a bracket 52 on turret 20. Riser guide tubes 60 mounted within turret 20 are connected to risers 22 and extend upwardly through turret 20 for connection to suitable conducts for storage of hydrocarbons within storage vessel 10, or for possible transport to another adjacent vessel, as well known.

Support buoys 28 aid in providing a restoring force upon movement of vessel 10 because a large portion of the axial forces for each anchor line 26 is directed into a horizontal component which provides a relatively large torque force exerted through chain 30 to assist in rotation of turret 20. As a result of these relatively large torque forces exerted by anchor legs 26 against turret 20, a separate turret drive mechanism is not required.

Figure 5:
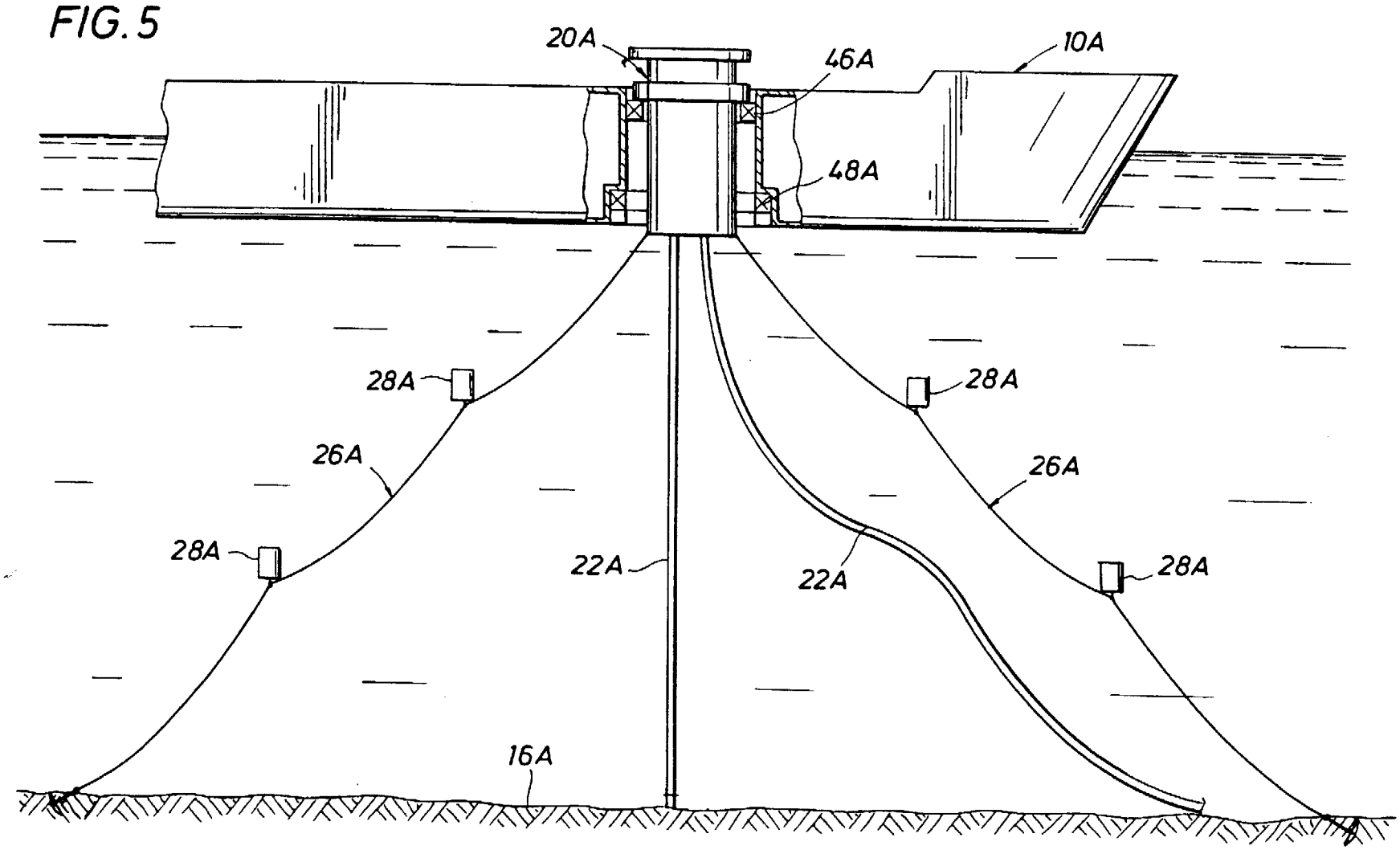
FIG. 5 is a schematic elevational view of a product storage vessel moored with a plurality of anchor legs each having a plurality of submerged support buoys.

Embodiment of FIG. 5

Referring to FIG. 5, a plurality of modified catenary anchor legs 26A are shown connected to turret 20A of storage vessel 10A. Turret 20A is mounted with upper (axial) and lower (radial) bearing assemblies 46A, 48A for relative rotation. Product risers 22A extend from sea floor wells or manifolds on the sea floor 16A to turret 20A. Each anchor leg 26A has a plurality of submerged support buoys 28A connected thereto to provide a permanent mooring for the storage vessel 10A to maintain vessel 10A on station during storms, currents, tides, or the like, and to permit enhanced horizontal components of the anchor leg catenary forces. By providing a plurality of submerged support buoys 28A for each anchor leg 26A, the horizontal component of the total anchor leg catenary forces at the connection to turret 20A is increased, and the total vertical component of the anchor leg catenary forces at the connection to turret 20A is decreased relative to the arrangement with only one submerged buoy in an anchor leg. Buoys 28A are of a size and submerged at sea level depths similar to support buoys 28 of the embodiment of FIGS. 1–4, but each additional submerged buoy in an anchor leg is spaced at a greater distance from the turret 20A and at a lower submerged depth. Each anchor leg 26A has a long length line between turret 20A and the adjacent support buoy 28A, and a long length line between adjacent support buoys 28A to form catenaries sufficient to direct a major portion of the axial forces along each anchor leg into a horizontal component. Anchor legs 26A are connected to support buoys 28A through downwardly extending plates on buoys 28A so that the anchoring forces are not transmitted directly through buoys 28A. The long length line may comprise cables, pipes, chains or any combination thereof.

Figure 6:
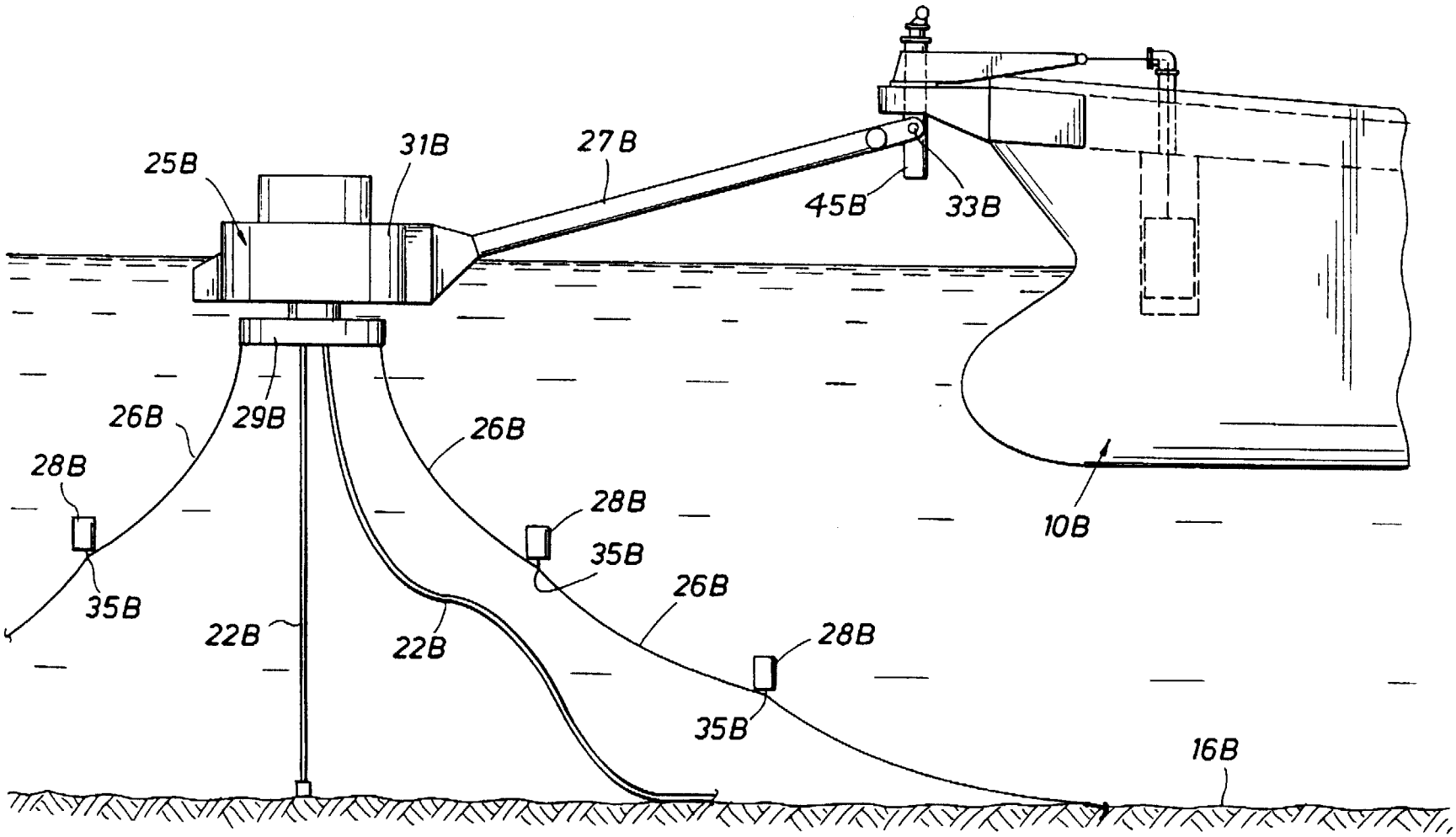
FIG. 6 is a schematic elevational view of the bow of a storage vessel having a yoke moored to a mooring buoy attached thereon, with the mooring buoy supported by a plurality of anchor legs each having a plurality of submerged support buoys.

Embodiment of FIG. 6

Referring to FIG. 6, a modified mooring system is shown for an offloading mooring buoy generally indicated at 25B having an upper portion 31B and a lower portion 29B. A yoke or boom 27B is rigidly secured to upper portion 31B and is pivotally mounted at 33B to a connecting member or post 45B on the bow of vessel 10B.

Lower or stationary portion 29B is secured to the sea bed 16B by anchor legs 26B, and upper or rotative portion 31B is mounted for rotation on lower portion 29B about a generally vertically extending axis. Each anchor leg 26B preferably has a plurality of submerged support buoys 28B connected to anchor leg or line 26B from a suitable connecting plate 35B extending from each submerged buoy 28B so that anchoring forces are transmitted by line 26B through plate 35B.

Vessel 10B in cooperation with yoke 27B and upper buoy portion 31B weathervanes about lower portion 29B of offloading mooring buoy 25B. Yoke 27B prevents vessel 10B from overrunning offloading mooring buoy 25B. Each anchor leg 26B has a long length line between lower buoy portion 29B and the support buoy 28B, and a long length line between adjacent support buoys 28B to form catenaries sufficient to direct a major portion of the axial forces along each anchor leg into a horizontal component. The long length line may comprise cables, pipes, chains or any combination thereof. However, anchor legs 26B may, if desired, be similar to anchor leg 26 in the embodiment of FIGS. 1–4 with only a single submerged anchor line support buoy connected to each anchor leg.

Product risers 22B extend from offloading mooring buoy 25B to the sea bed 16B and to subsea wells or manifolds (not shown). Anchor legs 26B provide a permanent mooring for offloading mooring buoy 25B. Offloading mooring buoy 25B is constructed for positioning on yoke 27B to provide a mooring arrangement for vessel 10B when offloading mooring buoy 25B is mounted on connector post 35B. Thus, vessel 10B may weathervane about lower buoy portion 29B during storms, currents, tides or the like. Support buoys 28B are of a displacement and submerged depth generally similar to buoys 28 of the embodiment shown in FIGS. 1–4.

In some instances when multiple support buoys are provided for each anchor line, the submerged depth of the lowermost support buoy may exceed 150 meters, and the displacement of each support buoy may be less than twenty (20) metric tons, such as about fifteen (15) metric tons, for example.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method for permanently mooring a floating storage vessel (10A, having a turret (20A) in the sea with anchor legs (26A) for remaining on station at all times without any quick disconnection of the turret from the anchor legs and any quick reconnection of the turret to the anchor legs for temporary removal of the vessel and with the vessel capable of maintaining a heading toward environmental forces; said method comprising the steps of:

mounting said turret (20A, ) in a well at a position forward of a vertical center line of said vessel (10A) on a bearing assembly (46A) so that relative rotation of said turret and said vessel tends to occur when a longitudinal center line of said vessel is not aligned with environmental forces of the sea;

mooring said vessel to said sea bed solely with said anchor legs by disposing a plurality of anchor legs (26A) between the sea bed and said turret (20A) with each of said anchor legs being fixedly secured to said turret without any quick disconnection of said legs from said turret or any quick reconnection of the legs to said turret to permit temporary removal of the vessel;

extending a plurality of risers (22A) from the turret (20A) downwardly from said turret to the sea bed to receive oil or gas from production units on the sea bed;

fixedly securing a plurality of support buoys (28A) to each of said anchor legs (26A) at predetermined positions in each anchor leg between the sea bed (16A) and said turret (20A);

forming each anchor leg (26A) with long length flexible anchor leg lines connected to said turret and said plurality of support buoys for dividing each anchor leg into at least a turret-to-buoy section, a buoy to buoy section, and a buoy to-sea section, each section forming a uniform curved catenary sufficient to space each anchor leg from said risers at all times and sufficient to direct a large portion of the axial forces along each anchor leg into a horizontal component to provide a large torque force to assist in rotation of said turret (20A); and providing each of said support buoys (28A) with a buoyancy sufficient to submerge each support (28A) buoy to a predetermined depth while connected to said anchor leg, the buoyancy of each of said support buoys being commensurate with a size of said vessel and said turret to provide enhanced horizontal components of forces on said turret between said turret and said support buoys (28A), such that when said environmental forces tend to cause said vessel to weathervane about said turret, said horizontal components of force on said turret through said anchor legs are sufficiently high such that torque on said turret causes said vessel to weathervane about said turret on said bearing assembly to maintain a heading of said vessel into said prevailing environmental forces.

2. A permanently moored floating storage vessel (10A) for remaining on station at all times including a turret (20A) mounted in a well at a position forward of a vertical center line of said vessel on a bearing assembly (46A) so that rotation of said turret tends to occur where a longitudinal center line of said vessel is not aligned with environmental forces of the sea, said vessel being moored solely by a plurality of anchor legs (26A) each fixedly secured to the turret at one end without any quick disconnection or reconnection thereto to permit temporary removal of the vessel and connected to the sea bed at the other end, and risers (22A) extending downwardly from the turret to the sea bed for receiving hydrocarbons from production units, wherein said vessel includes an improvement comprising:

a plurality of submerged support buoys (28A) fixedly secured at predetermined depths below sea level in each anchor leg for dividing each anchor leg into at least a turret-to-buoy section, a buoy to buoy section, and a buoy to-sea section, each section forming a uniform curved catenary sufficient to space each anchor leg (26A) from the risers at all times and sufficient to direct a large portion of the axial forces for each anchor leg into a horizontal component to provide a large torque force to assist in rotation of said turret (20), the horizontal component of the weight of each anchor leg adjacent each buoy being greater than the vertical component of such anchor leg adjacent each buoy, each anchor leg fixedly connected to said turret without any quick disconnection from said turret and any quick reconnection to said turret for temporary removal of the vessel, said support buoys (28A) being designed and arranged to have a buoyancy commensurate with a size of said vessel and said turret to provide enhanced horizontal components of forces on said turret from each anchor leg, such that when said environmental forces tend to cause said vessel to weathervane about said turret, said horizontal components of forces on said turret through each anchor leg are sufficient to provide torque great enough on said turret to cause said vessel to weathervane about said turret on said bearing assembly to maintain a heading of said vessel into said prevailing environmental forces.

3. A method for permanently mooring a floating mooring buoy (25B) in the sea with anchor legs (26B) without any quick disconnection of the mooring buoy from the anchor legs and any quick reconnection of the mooring buoy to the anchor legs for temporary removal of the mooring buoy; said method comprising the steps of:

mooring said mooring buoy (25B) to said sea bed solely with said anchor legs (26B) by disposing a plurality of anchor legs between the sea bed and said mooring buoy (25B) with each of said anchor legs being fixedly secured to said mooring buoy without any quick disconnection of said legs from said mooring buoy or any quick reconnection of the legs to said mooring buoy to permit temporary removal of the mooring buoy;

extending a plurality of risers (22B) supported from the mooring buoy downwardly from said mooring buoy to the sea bed to receive oil or gas from production units on the sea bed;

securing a plurality of support buoys (28B) to each of said anchor legs (26B) at predetermined positions in each anchor leg between the sea bed and said mooring buoy;

forming each anchor leg with a long length flexible anchor leg line between said mooring buoy (25B) and said sea bed for dividing each anchor leg line into at least a mooring buoy to support buoy section, a support buoy to support buoy section, and a support buoy to sea-floor section, each section having a length and direction forming a uniform curved catenary sufficient to space said anchor leg line from said risers at all times and sufficient to direct a large portion of the axial forces along each anchor leg into a horizontal component to provide a large torque force to assist in rotation of said mooring buoy (25B); and providing each support buoy (28B) with a buoyancy sufficient to submerge said buoy at a predetermined depth while connected to said anchor leg line, the buoyancy being sufficient to provide enhanced horizontal components of forces on said mooring buoy along those portions of said anchor leg lines between said mooring buoy and said buoy.

4. The method of claim 3 including the steps of:

permanently connecting said mooring buoy (25B) to a floating storage vessel (10B) to permit said vessel to weathervane about said mooring buoy (25B) with the horizontal forces on said mooring buoy through said anchor leg lines sufficiently high so that environmental forces tend to cause said vessel to weathervane about said mooring buoy without the need for powered drives on said vessel to maintain a head of the vessel toward environmental forces.

5. The method of claim 4 including the steps of:

providing said support buoy (25B) with a displacement of at least about twenty (20) tons; and submerging said support buoy (25B) at a depth below sea level at least about thirty-five (35) meters.

6. A method of mooring a vessel floating on a body of water above a sea floor including a turret and vertical bearings for relative rotation of said vessel about said turret, said vessel being moored solely by laterally and downwardly extending anchor legs securing said turret to said sea floor without any quick connection or any quick disconnection between said anchor legs and said turret, the method including the steps of:

establishing only anchor legs between said turret and said sea floor as the sole means for mooring said vessel;

placing a plurality of buoys at predetermined lateral distances away from said turret in each of said anchor legs, whereby each anchor leg is divided into at least a turret-to-buoy section, a buoy-to-buoy section and a buoy-to-sea floor section; and establishing each buoy at a sufficient distance from said turret and with a predetermined amount of buoyancy for forming a uniform curved catenary in each section and whereby weight of said buoy-to-sea floor section and of said buoy-to-buoy section of said anchor leg is not transferred to said turret and about fifty (50) percent of the weight of said turret-to-buoy section is transferred to said turret with the result that vertical load of said anchor legs on said turret is reduced and horizontal restoring forces are increased by said predetermined amount of buoyancy in each buoy relative to non-disconnectable mooring systems having no submerged buoys in anchor legs.

7. A mooring method for a mooring buoy floating on a body of water above a sea floor where said mooring buoy includes a rotatable part which is rotatable about a stationary part, said stationary part being moored solely by laterally and downwardly extending anchor legs for securing said stationary part to said sea floor without any quick connection or any quick disconnection between said anchor legs and said stationary part, the method including the steps of:

establishing only anchor legs between said stationary part and said sea floor as the sole means for mooring said mooring buoy with said stationary part of said mooring buoy being substantially non-rotative with respect to the sea floor;

placing a plurality of support buoys at predetermined lateral distances away from said turret in each of said anchor legs, whereby each anchor leg is divided into at least a stationary part-to-buoy section, a buoy-to-buoy section and a buoy-to-sea floor section; and establishing each support buoy at a sufficient distance from said stationary part and with a predetermined amount of buoyancy for forming a uniform curved catenary in each section and whereby weight of said buoy-to-sea floor section and of said buoy-to-buoy section of said anchor leg is not transferred to said stationary part and about fifty (50) percent of the weight of said stationary part-to-buoy section is transferred to said stationary part with the result that vertical load of said anchor legs on said stationary part is reduced and horizontal restoring forces are increased by said predetermined amount of buoyancy in each buoy relative to non-disconnectable mooring systems having no submerged buoys in anchor legs.

* * * * *